United States Patent [19]

Mayo

[11] 4,213,445

[45] Jul. 22, 1980

[54] FIREPLACE COMBUSTION AIR DUCT APPARATUS

[75] Inventor: Carlos Mayo, Springdale, Ark.

[73] Assignee: C. Mayo, Inc., Springdale, Ark.

[21] Appl. No.: 933,662

[22] Filed: Aug. 14, 1978

[51] Int. Cl.[2] ..... F24B 13/02

[52] U.S. Cl. ..... 126/143; 126/123; 126/242

[58] Field of Search ..... 126/120, 123, 122, 288, 126/143, 242, 245, 243, 244

[56] References Cited

U.S. PATENT DOCUMENTS

| | | | |
|---|---|---|---|
| Re. 29,443 | 10/1977 | Vaughn | 126/120 |
| 80,731 | 8/1868 | Hattan | 126/288 X |
| 426,477 | 4/1890 | Teale | 126/143 X |
| 695,840 | 3/1902 | Rose et al. | 126/123 |
| 1,189,261 | 7/1916 | Kincaid et al. | 126/122 X |
| 2,740,398 | 4/1956 | Collins | 126/242 |
| 2,819,711 | 1/1958 | Robinson | 126/242 |
| 3,269,384 | 8/1966 | Adelt | 126/288 |
| 3,981,292 | 9/1976 | Lilly et al. | 126/123 X |
| 4,068,649 | 1/1978 | Johnson | 126/120 |
| 4,106,475 | 4/1978 | Mayes | 126/242 |

FOREIGN PATENT DOCUMENTS

| | | | |
|---|---|---|---|
| 2273238 | 12/1975 | France | 126/143 |
| 9720 | of 1914 | United Kingdom | 126/120 |

*Primary Examiner*—Samuel Scott
*Assistant Examiner*—Gerry Anderson
*Attorney, Agent, or Firm*—Robert R. Keegan

[57] ABSTRACT

There is disclosed a fireplace combustion air duct including a main duct of heavy sheet metal or other refractory material suitable for the high temperature environment of a woodburning fireplace, which main duct is open at least partly along the bottom to receive air from the ash clean-out opening or other opening in the floor of a woodburning fireplace and also open at the forward end. Sliding into the forward end of the main duct is an adjustable duct open at least at the forward top portion thereof and configured to fit in telescoping fashion within the main duct. The adjustable duct is provided on the front end with a deflector plate for directing air from the duct to the rear of the fireplace so that logs or other combustible material on or directly above the duct will be directly exposed to a strong flow of air from the combustion air duct. The combustion air duct is preferably provided with arms on the sides of the main duct which together with the main duct act as fire dogs for logs and do away with the necessity for any other fire dogs or log basket for the fireplace. The main duct is also preferably provided with a low barrier at the forward end to prevent ashes or coals from falling into the opening at the front of the combustion air duct.

12 Claims, 2 Drawing Figures

FIREPLACE COMBUSTION AIR DUCT APPARATUS

Figure 1:
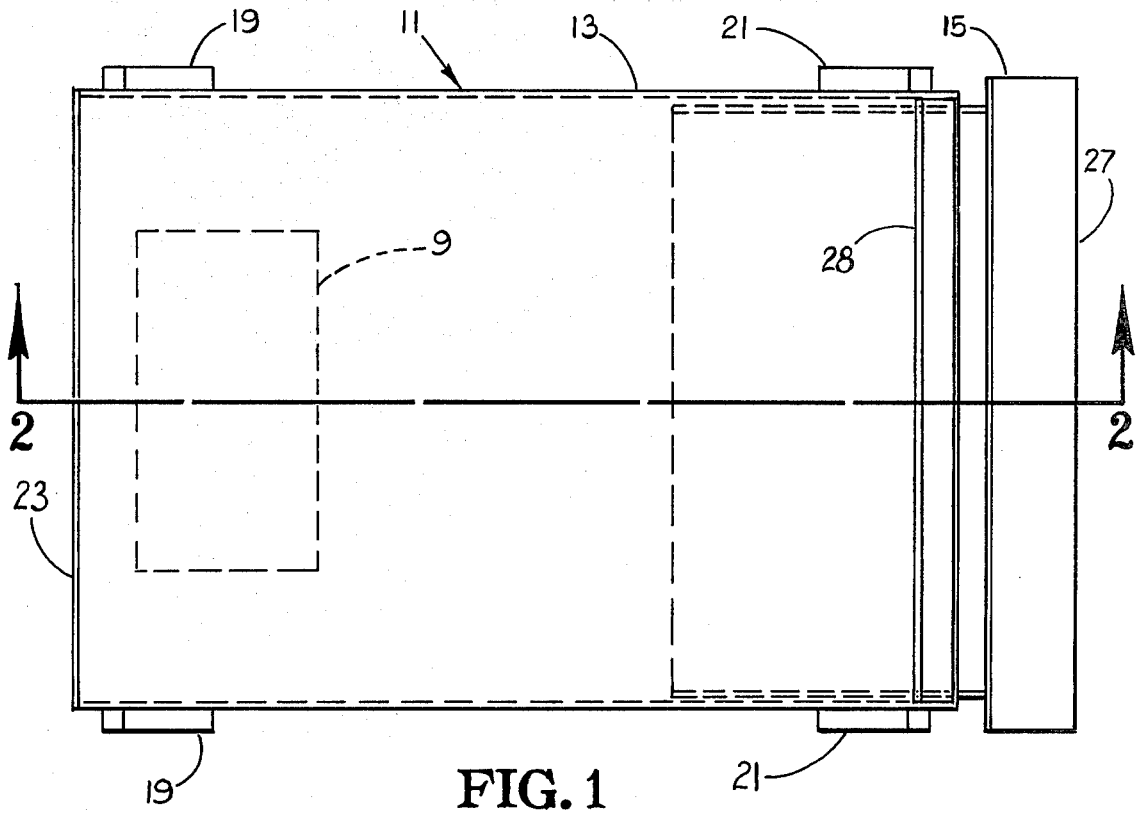

This invention relates to apparatus for controlled supply of outside air to support combustion in woodburning fireplaces. Much attention has recently been given to improving the output and efficiency and heat from woodburning fireplaces, so that the burning of renewable fuels such as wood may aid in the shortage of fossil fuels and also reduce fuel or electricity costs for heating.

Many woodburning fireplaces are built originally or modified to include heat exchange systems so that the air from the living space is circulated behind the walls of the firebox or otherwise effectively heated by the fireplace before being returned to the living space. Such systems enhance the heat production of a fireplace which otherwise casts heat into the living space essentially only by radiation. Such heat exchange systems do not, however, attack a known problem with fireplace heating involving the necessity for a large volume of air to support combustion in the fireplace. Fireplaces are typically permitted to draw combustion air through the fireplace opening from the interior of the house. Where a fireplace is provided with a glass door it customarily has openings at the bottom to permit combustion air to enter from the living space. Such combustion air withdrawn by the fireplace from the living space must be replaced and there is no source for it other than outside air. This outside air is at a temperature typically from 20° F. to 100° F. colder than the air in the living space and sufficient heat must be supplied to it to raise it to the desired living space air temperature. While it is well known, it is not widely recognized that this problem with supplying combustion air to a woodburning fireplace can completely offset the heating effect of the fireplace so that operation of the fireplace actually makes the house colder rather than warmer (except for that space immediately in front of the fireplace receiving radiant heat).

According to the present invention, it has been discovered that the ash clean-out vent which is commonly found in fireplaces in most areas can be converted to a very effective source of fireplace combustion air by use of the simple and rugged apparatus of the present invention.

It has been previously proposed, of course, to supply outside air to woodburning fireplace fireboxes, but such previous arrangements have not had the effectiveness of the present invention. In particular, previous arrangements have not effectively directed the air on the logs or other combustible material but rather have permitted large quantities of such air to be drawn up the chimney without passing over the combustible material. Furthermore, such pervious arrangements have not had means for directly inducing air flow through the fireplace combustion air duct but rather relied on the draft of the chimney only.

As will be more fully understood from the following detailed description, the fireplace combustion air duct according to the present invention directs the combustion air to the combustible material with great effectiveness and also, due to heating of the air in the duct, produces a draft effect drawing in the air from the exterior, which effect is separate and in addition to the effect of the chimney draft. The volume of combustion air from the exterior may be controlled by increasing or decreasing the size of the opening at the exit for the air duct apparatus. The air duct may also be completely closed as would be desired when the fireplace is not in use.

In addition to providing the above-described advantages, it is an object of the present invention to provide apparatus for supplying combustion air to woodburning fireplace from the exterior of the house or other structure which is simple and rugged and highly effective to direct the combustion air to the logs or other fuel.

It is another object of the present invention to provide combustion air duct apparatus which cooperates with an existing ash clean-out opening to the exterior of the house and which requires no structural modifications for installation of the apparatus.

It is still another object of the present invention to provide air duct apparatus for fireplaces wherein the air exit opening is adjustable for fireplaces wherein the air exit opening is adjustable by moving a telescoping front section of the duct to the front or rear with a fireplace poker or other tool.

It is another object of the invention to provide fireplace combustion air duct apparatus which extends under the stack of logs in the fireplace, is heated by the coals, and heats the incoming air to aid in inducting outside air.

Figure 2:
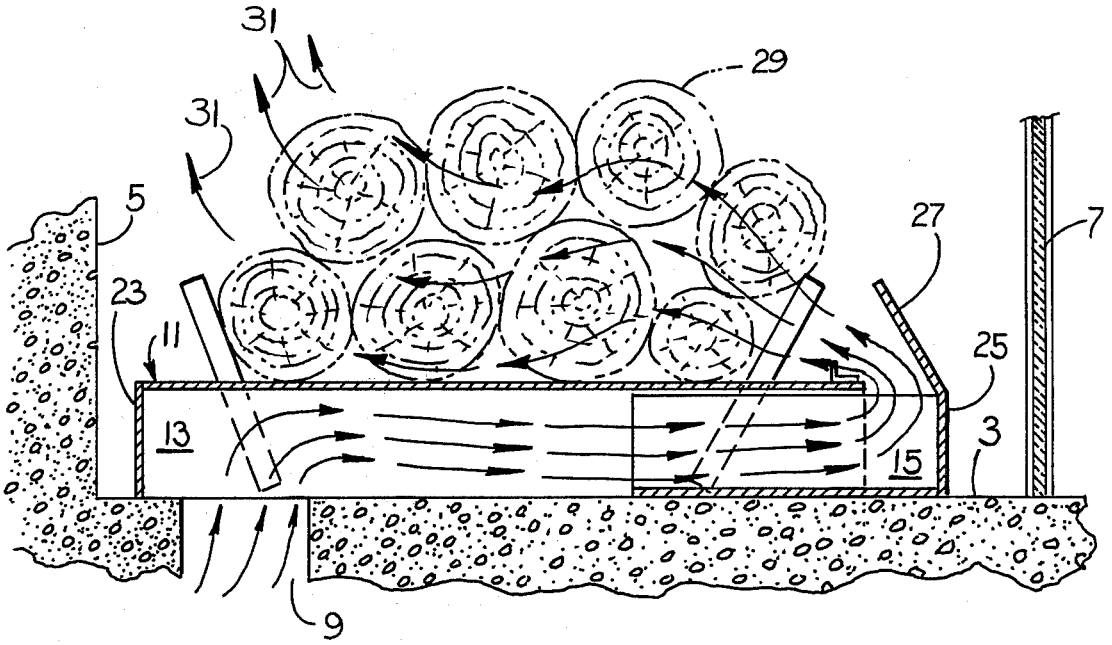

Other objects and advantages of the invention will be apparent from consideration of the following description and the appended drawings in which:

FIG. 1 is a top plan view of a fireplace combustion air duct apparatus according to the invention; and FIG. 2 is a sectional view of the apparatus of FIG. 1 taken along the line 2—2 in FIG. 1.

Referring now to the drawings, an air duct apparatus 11 includes a main duct 13 and an adjustable duct 15. The air duct apparatus 11 rests on the floor 3 of the fireplace, as best seen in FIG. 2. The bottom of the main duct 13 is open and thus the main duct 13 communicates with the ash clean out-opening 9 in the floor 3 of the fireplace.

The ash clean-out opening 9 will customarily be provided with a cover with a hinged door. This cover (not shown) is usually readily removable and is preferably removed as it is not necessary when the fireplace combustion air duct apparatus is in place. If desired, the cover and door for the ash-clean out could be left in place, in which case the door should be secured in the open position. The main duct 13 is placed to the rear of the fireplace sufficiently to cover the opening 9 of the ash clean-out. If desired, the main duct 13 may be placed so that its rear wall 23 abuts the rear wall 5 of the fireplace.

The adjustable duct 15 fits in telescoping fashion inside the main duct 13 and is preferably from about ⅓ to ½ the length of the main duct 13.

The adjustable duct 15 is preferably closed on the bottom and open on the top. Thus when placed as shown in FIG. 2, an opening extends from the bottom rear of the main duct 13 over the ash clean-out opening 9 through the main duct 13 and the adjustable duct 15 to the open space between the front wall 25 of the adjustable duct 15 and the front end of the main duct 13.

The telescoping arrangement of adjustable duct 15 not only permits the opening at the front thereof to be closed or opened to varying degrees but also permits the duct to be moved out to a wider opening to take advantage of the greater depth of the fireplace firebox if it is available. Accommodation to different depths of fireboxes may also be made by locating the rear wall 23 of the duct 13 closer to or farther from the rear wall 5 of the fireplace. Accordingly, it has been found that fireplace combustion air duct apparatus with a total length of approximately 18 inches when closed will accommodate nearly all fireplaces. It is, of course, a simple matter to also provide main duct elements which are somewhat shorter or somewhat longer to accommodate fireplaces of unusual dimensions.

The front 25 of adjustable duct 15 extends upward and is preferably bent slightly to the rear to form a deflector 27 serving to deflect the air to the rear of the firebox onto the logs 29. In addition to the air deflection produced by deflector 27, the air exiting from adjustable duct 15 will be drawn to the rear of the firebox by the action of the fireplace chimney which is located at the top rear of the firebox (not shown in FIG. 2). As a result of these combined actions, the exterior air provided for combustion by the fireplace combustion air duct apparatus will be effectively directed onto the burning logs and very little will be misdirected where it is drawn up the chimney without opportunity to supply oxygen to the burning fuel. This action is indicated in FIG. 2 by the arrows 31; the arrows only give a general indication of the air flow and are not intended to be a precise analytical representation thereof.

In the preferred embodiment shown, arms 19 at the rear of the main duct 13 and other arms 21 at the front of main air duct 13 are secured to the main duct and serve as a cradle or basket for the logs 29. As a result, the fireplace combustion air duct apparatus also serves as a log basket and no additional apparatus for use as fire dogs or a log basket is required. In a typical embodiment the width of the air duct apparatus may be approximately one foot. This is an ample width to support the logs so that they do not tip or fall to one side or the other, yet the logs will generally extend substantially beyond the edges of the air duct apparatus. The basket formed by the air duct apparatus and arms 19 and 21 does not have an open grate structure customarily utilized for log baskets, but it has been found that this is no impediment to the efficient burning of the logs or other fuel. This is due perhaps to the air flow provided by the combustion air duct apparatus which eliminates the need for air flow through the open grate work of the conventional log basket. It may be noted that other more complicated log retaining arms may be secured to the air duct apparatus according to the invention rather than the simple arms 19 and 21 shown for illustration.

It is of course necessary that the duct apparatus according to the invention be formed of a refractory material, and it is found that heavy gauge sheet steel provides a very rugged and durable material. For rigidity and durability, the sheet steel should be approximately ⅛ inch in thickness or more.

The main duct 13 may be conveniently formed by bending a single sheet of steel into the shape of an inverted open channel and closing the end 23 by welding a piece of sheet steel thereto. In similar fashion, the adjustable duct 15 may be formed of one sheet into the shape of an open channel at the front of which is welded a sheet steel panel forming the front 25 and the deflector 27 of the adjustable duct 15.

It is desirable to have a lip on the top forward portion of main duct 13 to prevent ashes and coals from falling into the opening between adjustable duct 15 and main duct 13. Such a lip or barrier 28 may be provided by a steel angle iron welded to the top front portion of the main duct 13.

Numerous variations may be made in the configuration of the combustion air duct apparatus without departing from the invention. A basic purpose is to have one or more ducts of refractory material leading from the ash clean-out at the rear of the fireplace to near the front of the fireplace firebox together with appropriate means for deflecting the air to return toward the back of the fireplace flowing over and around the logs or other combustible material. Thus rather than a single large rectangular duct as illustrated, two or more smaller ducts might lead from a rear enclosure over the ash clean-out to the forward part of the firebox. These ducts might be placed close together or might be spaced far apart. They could be of rectangular, square or circular cross section.

The air duct apparatus according to the invention is exposed to very high temperatures, and it may as to portions thereof reach dull red heat. Thus it is especially important that the apparatus be of refractory material such as carbon steel, especially as to the main duct 13. Other refractory materials such as high temperature steel alloys, alloys of other metals, reinforced fire-clay, or other refractory ceramic may be used to form the ducts. The adjustable duct 15 is in effect air cooled and not exposed to such high temperatures, but it is very conveniently also made of carbon steel. It would be possible to make the adjustable duct or at least the front portion thereof of brass, aluminum or some other non-refractory material for the sake of appearance. Non-refractory material would not, however, be suitable for the main duct 13 in any circumstances.

The operation of the combustion air duct apparatus has nto been analyzed in detail, but the following general description thereof is believed accurate.

As shown in FIG. 2, the combustion air duct apparatus may be utilized as a log cradle. Alternatively, it may be placed under a conventional log cradle, grate, or firelogs. The duct apparatus will normally be from two to four inches in height. This permits it to fit under most log baskets, if such arrangement is desired. In that case, the arms 19 and 21 or, any event, arms 19 may be omitted. One situation in which this may be desirable is where the user wishes to utilize a natural gas fire starter which normally has a perforated tube extending into the fireplace from one side. Such tube may readily be adjusted to fit over the air duct apparatus and under a conventional log basket. Natural gas fire starters may in some cases also be employed with the combustion air duct apparatus used alone.

The log fire will be started in any case in the usual manner using paper or wood for kindling, natural gas or whatever method the user customarily employes. If there is a glass door on the fireplace as shown at 7, it would of course be open while the fire was being started. However, once the fire was started and the chimney draft established, the fireplace glass door 7 could be closed. Any vents in the fireplace screen to supply combustion air could also be closed as the air would be supplied by the combustion air duct apparatus. In operation, the combustion air duct apparatus would of course be open as shown in FIG. 1 or FIG. 2, and the effect of the chimney draft would be to create a suction which would draw outside air through the ash clean-out 9, main duct 13, adjustable duct 15, and over and around logs 29, as generally indicated by the arrows in FIG. 2.

It is of course necessary for the ash pit into which the ash clean-out 9 leads to be open to the outside air. The clean-out 9 therefore should not be clogged with ashes, and if the door to the ash pit is tight fitting, it should be open or replaced with a coarse screen. If desired, the ash clean-out may still be used for transporting ashes to the ash pit since the duct apparatus is not fastened in place and can be tipped on its side or otherwise moved to uncover the clean-out opening.

With fireplace door 7 closed or substantially closed, the induction of air through the combustion air duct apparatus will be in a large share due to the suction effect of the chimney draft. To some extent in that case, however, and even more so when the fireplace door 7 is not closed, there is another effect tending to induce air to flow through the combustion air duct apparatus. When the fireplace is in operation long enough to generate a bed of coals on and around the main duct 13, it will become very hot, in some places perhaps reaching dull red heat. Consequently, the air within the main duct 13 will be heated to a substantial extent, and even in the absence of the chimney draft, it would therefore tend to rise and exit out the front of the apparatus. This would in turn create a partial vacuum drawing more air in from the outside. One might in some cases wish to increase this heating effect by adding vertical fins extending downward from the top of main duct 13 parallel to the side walls thereof and running all or part of its entire length. Such additional fin or fins would, if also made of steel sheet welded to the top panel, substantially rigidify the main duct 13.

From the foregoing explanation it will be seen that apparatus according to the invention may be utilized in a wide variety of circumstances and is useful for fireplaces with or without glass door closures for the fireplace opening. In addition to the variations and modifications to the invention described or suggested above, other modifications and variations will be apparent to those skilled in the art, and accordingly the scope of the invention is not to be deemed limited to the specific variations or modifications shown, described, or suggested but is rather to be determined by reference to the appended claims.

What is claimed is:

1. Fireplace combustion air duct apparatus having front, rear top, bottom and side portions comprising
   - a pair of ducts formed of rigid material, one of said ducts telescoping within the other,
   - a first of said pair of ducts being closed on the top, two sides and the rear and having an opening in the bottom adapted to be placed over a fireplace ash clean-out and receive outside air therethrough,
   - the second one of said ducts being closed on two sides and the front having an opening at the frontward top portion, and
   - said second duct having an air deflector adjacent said opening for causing air to be deflected rearwardly from said opening.

2. Apparatus as claimed in claim 1 wherein said first duct is formed of rigid sheet material bent in the shape of an open channel having the rear closed and the front open.

3. Apparatus as claimed in claim 1 wherein said second duct is substantially shorter than said first duct.

4. Apparatus as claimed in claim 1 wherein said second duct is from one-third to one-half the length of said first duct.

5. Apparatus as claimed in claim 1, 2 or 3 further having at least one pair of upwardly extending arms secured on the sides of said apparatus for restraining logs from movement to the end of said duct.

6. Apparatus as claimed in claim 1 wherein said first duct has an upwardly extending barrier near the forward end thereof adapted to prevent coals or ashes from dropping off the forward end thereof.

7. Fireplace combustion air duct apparatus having front, rear, top, bottom and side portions comprising
   - a pair of duct elements formed of rigid material,
   - a first of said pair of duct elements being closed on the top, two sides and the rear with a front opening and having an opening in the bottom adapted to be placed over a fireplace ash clean out and receive outside air therethrough,
   - the second one of said duct elements being shaped to adjust the size or close said front opening of said first duct element, at least one of said duct elements having an air deflector adjacent said front opening for causing air to be deflected rearwardly from said opening,
   - at least one pair of upwardly extending arms secured on the sides of said apparatus for restraining logs from movement toward the forward end of said duct.

8. Apparatus as claimed in claim 7 wherein said first duct element is formed of rigid sheet material bent in the shape of an open channel having the rear closed and the front open.

9. Apparatus as claimed in claim 8 wherein said second duct element is substantially shorter than said first duct element.

10. Fireplace combustion air duct apparatus having front, rear, top, bottom and side portions comprising
   - a pair of ducts formed of rigid refractory material, one of said ducts telescoping within the other,
   - a first of said pair of ducts being closed on the top, two sides and the rear and having an opening in the bottom adapted to be placed over a fireplace ash clean-out and receive outside air therethrough,
   - the second one of said ducts being closed on two sides and the front and having an opening at the frontward top portion,
   - said second duct having an air deflector adjacent said opening for causing air to be deflected rearwardly from said opening,
   - said first duct further having an upwardly extending barrier near the frontward end thereof adapted to prevent coals or ashes from dropping off the frontward end thereof, and
   - at least one pair of upwardly extending arms secured on the sides of said apparatus for restraining logs from movement to the end of said duct.

11. Apparatus as claimed in claim 10 wherein said first duct is formed of rigid sheet material bent in the shape of an open channel having the rear closed and the front open.

12. Apparatus as claimed in claim 10 wherein said second duct is from one-third to one-half the length of said first duct.

* * * * *